US012428783B1

(12) United States Patent
Raza et al.

(10) Patent No.: US 12,428,783 B1
(45) Date of Patent: Sep. 30, 2025

(54) LIGNIN REMOVAL FROM LIGNOCELLULOSIC WASTE USING REJECTED BRINE SOLUTION

(71) Applicant: UNITED ARAB EMIRATES UNIVERSITY, Al Ain (AE)

(72) Inventors: Mohsin Raza, Al Ain (AE); Basim Abu-Jdayil, Al Ain (AE); Ali Hassan Al Marzouqi, Al Ain (AE); Jawad Mustafa, Al Ain (AE)

(73) Assignee: UNITED ARAB EMIRATES UNIVERSITY, Al Ain (AE)

( * ) Notice: Subject to any disclaimer, the term of this patent is extended or adjusted under 35 U.S.C. 154(b) by 0 days.

(21) Appl. No.: 19/236,299

(22) Filed: Jun. 12, 2025

Related U.S. Application Data

(63) Continuation-in-part of application No. 18/143,264, filed on May 4, 2023, now abandoned.

(51) Int. Cl.
*D21C 3/18* (2006.01)
*D21C 9/06* (2006.01)

(52) U.S. Cl.
CPC *D21C 3/18* (2013.01); *D21C 9/06* (2013.01)

(58) Field of Classification Search
CPC ..... D21C 3/18; D21C 9/06
USPC ..... 162/53
See application file for complete search history.

(56) References Cited

U.S. PATENT DOCUMENTS

| | | | | |
|---|---|---|---|---|
| 10,279,510 | B2 | 5/2019 | Tamir | |
| 2021/0101814 | A1* | 4/2021 | Namazi | B01D 61/025 |
| 2021/0317026 | A1* | 10/2021 | Thomson | C04B 11/264 |
| 2022/0056156 | A1 | 2/2022 | Mohammad et al. | |

FOREIGN PATENT DOCUMENTS

| | | | | |
|---|---|---|---|---|
| CA | 2368872 | C | 11/2005 | |
| CN | 101962449 | B | 11/2012 | |
| JP | 2005239661 | A | 9/2005 | |
| WO | WO-2011149774 | A1 * | 12/2011 | C12P 7/40 |

OTHER PUBLICATIONS

Shill, K. et al., "Ionic liquid pretreatment of cellulosic biomass: enzymatic hydrolysis and ionic liquid recycle," Biotechnol. Bioeng. (2011), pp. 511-520, 108(3): pp. 511-520, Wiley Online Network.

* cited by examiner

*Primary Examiner* — Jacob T Minskey
(74) *Attorney, Agent, or Firm* — Nath, Goldberg & Meyer; Joshua B. Goldberg

(57) ABSTRACT

Lignocellulosic waste, such as date palm seeds, is treated with industrial waste such as rejected brine solution waste from a water treatment desalination plant to break down lignin and isolate and recover cellulose. Such a method is more cost effective and less toxic than other current and prior methods. Such a method concurrently solves two problems—usage of lignocellulose waste and usage of brine solution waste from a desalination treatment plant—to isolate and recover biocompatible, biodegradable versatile cellulose.

15 Claims, 2 Drawing Sheets

LIGNIN REMOVAL FROM LIGNOCELLULOSIC WASTE USING REJECTED BRINE SOLUTION

CROSS-REFERENCE TO RELATED APPLICATION

This application is a continuation-in-part of U.S. patent application Ser. No. 18/143,264, filed on May 4, 2023, the entire contents of which are incorporated herein by reference.

BACKGROUND

1. Field

The disclosure of the present patent application relates to lignin removal and extraction of cellulose from lignocellulosic waste by treatment with rejected brine from a water treatment desalination plant.

2. Description of the Related Art

Lignocellulosic waste is abundant throughout the world. For example, date palm seeds, a lignocellulosic waste from date palms, are particularly abundant in various areas of the world, including the UAE and other nearby Gulf states. Incineration or landfilling of lignocellulosic waste is not a viable option moving forward because it pollutes the environment. Researchers around the world are investigating the potential ways in which such lignocellulosic waste can instead be used to create value-added products. For example, isolation of cellulose from lignocellulosic materials is the subject of much research. Typically, cellulose isolation from lignocellulose waste is achieved by removing the lignin.

With increasing environmental sustainability, cellulose, the world's most abundant biopolymer with an annual supply of $1.5\times10^{12}$ tons, has attracted the interest of the scientific community. Due to its special properties, such as strong mechanical properties, renewability, biocompatibility, biodegradability, and chemical stability, cellulose has been widely used as reinforcement in polymer composites to produce environmentally friendly products. Cellulose is also of great interest in many other applications, including the production of filaments, hydrogels, aerogels, 3-D printing materials, wastewater adsorbents, and pharmaceutical drug delivery applications. The application of cellulose synthesis becomes even more interesting if it can be isolated from cheap and renewable materials. In this context, lignocellulosic waste materials can provide a sustainable source for cellulose production. This sole renewable energy source containing carbon, lignocellulosic biomass obtained from agricultural waste and forest detritus, has proven to be an ideal resource for conversion into cellulose and its derivatives. There are three primary components of lignocellulose: cellulose (40-50%), hemicelluloses (25-30%), and lignin (15-25%).

The conventional method of cellulose isolation involves treating lignocellulosic materials with either alkaline (NaOH or KOH) or chlorine (NaClO or $NaClO_2$). For example, Raza M et al., "Isolation and Characterization of Cellulose Nanocrystals from Date Palm Waste," ACS omega, vol. 7, no. 29, pp. 25366-25379, 2022, describes isolated cellulose from date palm stem waste using NaOH and $NaClO_2$ solutions with a percentage of 4% by weight. Similarly, Sun J et al., "Isolation and characterization of cellulose from sugarcane bagasse," Polymer degradation and stability, vol. 84, no. 2, pp. 331-339, 2004, describes isolated cellulose from sugarcane bagasse using NaOH, KOH and acetic acid sodium chlorite solution. Galiwango E et al., "Isolation and characterization of cellulose and α-cellulose from date palm biomass waste," Heliyon, vol. 5, no. 12, p. e02937, 2019, describes isolated cellulose from date palm waste using NaOH and hydrogen peroxide. Unfortunately, however, some of the materials currently used for cellulose isolation from lignocellulose waste are considered toxic chemical treatments.

A concurrent existing problem of ecological importance is the desalination of seawater, and the discharge of brine generated during the desalination of the seawater. For coastal desalination plants, the most practical and cost-effective method of disposing of the brine is to discharge it to the sea at the outlet of the plant. However, this direct discharge has several harmful effects on the environment. For one, the brine discharged has many properties that have a negative impact on the environment. It consists of highly concentrated salts such as NaCl and unreacted pretreatment chemicals and is a waste of particular concern because pumping it into the oceans increases salt concentrations and affects aquatic life. It also brings heavy metals with it from corrosion of the pipe and flash chamber walls. Therefore, the greatest environmental impact of desalination occurs at the outlet of the desalination plant.

Thus, it would be advantageous to combine a simultaneous solution to two major waste materials problems—lignocellulose waste and rejected brine solution from seawater desalination—in order to produce cellulose while eliminating or reducing the above problems and moving toward a circular and renewable economy while being cost effective.

SUMMARY

The present subject matter is related to the removal of lignin from lignocellulosic materials, including lignocellulose waste materials, using rejected brine solution waste to isolate and recover cellulose. Rejected brine solution is a waste product of water treatment plants for desalination. Lignocellulosic waste is treated with industrial waste such as the rejected brine solution to help break down lignin and recover cellulose. More specifically, it is proposed to extract cellulose from lignocellulosic waste by treatment with rejected brine from a water treatment desalination plant where date palm seeds, a lignocellulosic waste from date palms, are treated with crude, rejected brine solution from a desalination plant. Such a method is more cost effective and less toxic than other current and prior methods.

In one embodiment, the present subject matter relates to the removal of lignin from lignocellulose materials by treating the lignocellulose materials with rejected brine solution to break down and remove lignin and isolate and recover cellulose from the lignocellulose material. In this respect, the lignocellulose materials can be waste lignocellulose materials, including from date palms, and the rejected brine solution can be waste from a water treatment desalination plant.

In an embodiment, lignocellulose waste can be crushed, and the crushed waste can be mechanically mixed with the rejected brine solution (RBS) waste while heating to produce a dark brown slurry. The dark brown slurry can then be filtered, thereby producing a lignin-rich filtrate solution and a cellulose filter cake, then the cellulose filter cake is dried, producing the isolated cellulose.

Accordingly, in one embodiment, the present subject matter relates to a method for the removal of lignin from a lignocellulose material to extract cellulose from the lignocellulose material, the method comprising: providing a lignocellulose material; crushing the lignocellulose material; providing rejected brine solution waste from a water treatment desalination plant; mixing the crushed lignocellulose material with the rejected brine solution waste while heating to obtain a mixture; and filtering the mixture to obtain the cellulose.

In another embodiment, the present subject matter relates to the cellulose that is isolated and extracted from the lignocellulose waste by the methods presented herein.

These and other features of the present subject matter will become readily apparent upon further review of the following specification.

DETAILED DESCRIPTION OF THE PREFERRED EMBODIMENTS

Figure 1:
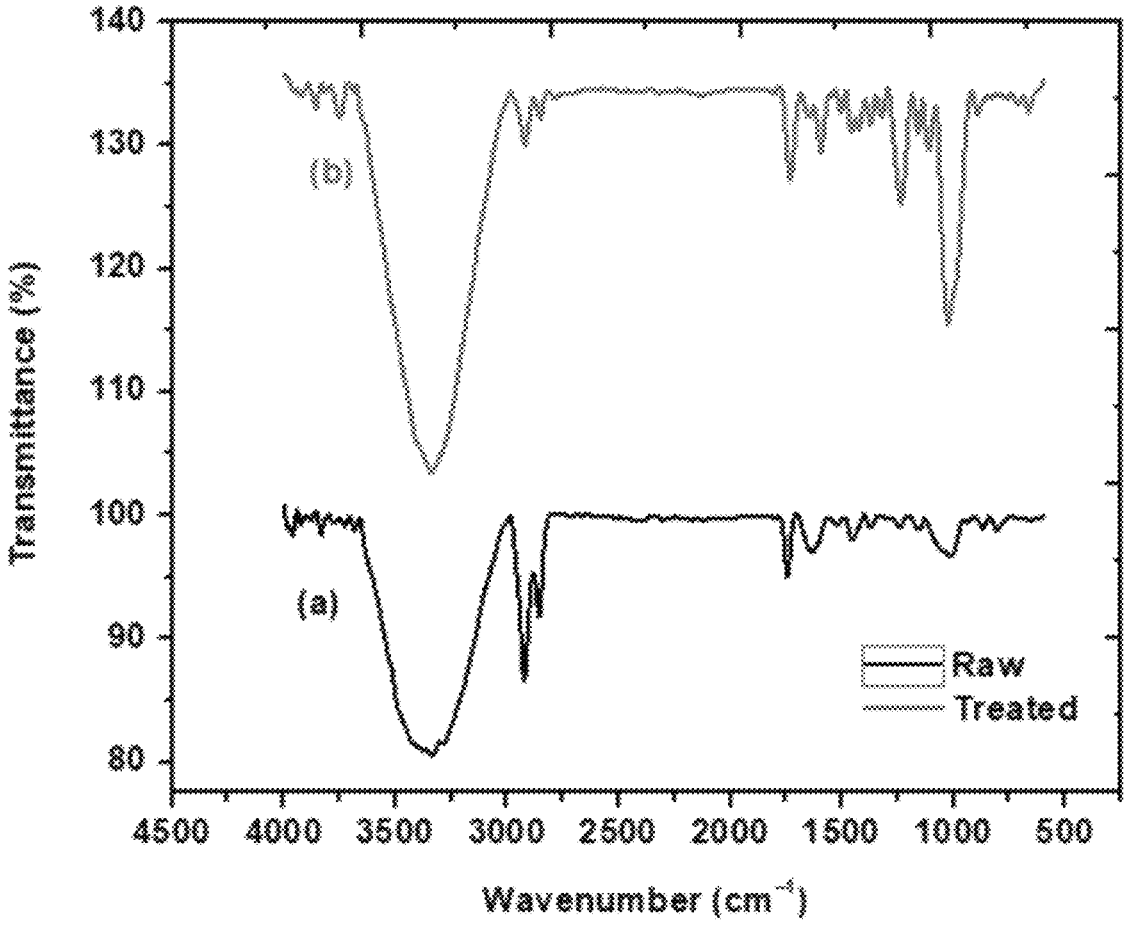
FIG. 1 shows FTIR spectra of (a)-raw and (b)-treated date seeds.

The following definitions are provided for the purpose of understanding the present subject matter and for construing the appended patent claims.

Definitions

Throughout the application, where compositions are described as having, including, or comprising specific components, or where processes are described as having, including, or comprising specific process steps, it is contemplated that compositions of the present teachings can also consist essentially of, or consist of, the recited components, and that the processes of the present teachings can also consist essentially of, or consist of, the recited process steps.

It is noted that, as used in this specification and the appended claims, the singular forms "a", "an", and "the" include plural references unless the context clearly dictates otherwise.

In the application, where an element or component is said to be included in and/or selected from a list of recited elements or components, it should be understood that the element or component can be any one of the recited elements or components, or the element or component can be selected from a group consisting of two or more of the recited elements or components. Further, it should be understood that elements and/or features of a composition or a method described herein can be combined in a variety of ways without departing from the spirit and scope of the present teachings, whether explicit or implicit herein.

The use of the terms "include," "includes", "including," "have," "has," or "having" should be generally understood as open-ended and non-limiting unless specifically stated otherwise.

The use of the singular herein includes the plural (and vice versa) unless specifically stated otherwise. In addition, where the use of the term "about" is before a quantitative value, the present teachings also include the specific quantitative value itself, unless specifically stated otherwise. As used herein, the term "about" refers to a ±10% variation from the nominal value unless otherwise indicated or inferred.

The term "optional" or "optionally" means that the subsequently described event or circumstance may or may not occur, and that the description includes instances where said event or circumstance occurs and instances in which it does not. For example, "optionally substituted alkyl" means either "alkyl" or "substituted alkyl," as defined herein.

It will be understood by those skilled in the art with respect to any chemical group containing one or more substituents that such groups are not intended to introduce any substitution or substitution patterns that are sterically impractical and/or physically non-feasible.

Unless defined otherwise, all technical and scientific terms used herein have the same meaning as commonly understood to one of ordinary skill in the art to which the presently described subject matter pertains.

Where a range of values is provided, for example, concentration ranges, percentage ranges, or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

Throughout the application, descriptions of various embodiments use "comprising" language. However, it will be understood by one of skill in the art, that in some specific instances, an embodiment can alternatively be described using the language "consisting essentially of" or "consisting of".

For purposes of better understanding the present teachings and in no way limiting the scope of the teachings, unless otherwise indicated, all numbers expressing quantities, percentages or proportions, and other numerical values used in the specification and claims, are to be understood as being modified in all instances by the term "about". Accordingly, unless indicated to the contrary, the numerical parameters set forth in the following specification and attached claims are approximations that may vary depending upon the desired properties sought to be obtained. At the very least, each numerical parameter should at least be construed in light of the number of reported significant digits and by applying ordinary rounding techniques.

The present subject matter is related to the removal of lignin from lignocellulosic materials, including lignocellulose waste materials, using rejected brine solution to isolate and recover cellulose. Rejected brine solution is a waste product of water treatment plants for desalination. Lignocellulosic waste is treated with industrial waste such as the rejected brine solution to help break down lignin. More specifically, the present subject matter relates to the extraction of cellulose from lignocellulosic waste by treatment with rejected brine from a water treatment desalination plant where date palm seeds, a lignocellulosic waste from date palms, are treated with crude, rejected brine solution from a desalination plant. Such a method is more cost effective and less toxic than other current and prior methods.

Accordingly, in one embodiment, the present subject matter relates to a method for the removal of lignin from a lignocellulose material to extract cellulose from the lignocellulose material, the method comprising: providing a lignocellulose material; crushing the lignocellulose material; providing rejected brine solution waste from a water treatment desalination plant; mixing the crushed lignocellulose material with the rejected brine solution waste while heating to obtain a mixture; and filtering the mixture to obtain the cellulose.

In an embodiment, the lignocellulose material used herein can comprise waste lignocellulose material. In a further embodiment, the lignocellulose material can comprise waste date seeds, date seeds, or combinations thereof.

In another embodiment, the rejected brine solution waste can be a highly concentrated solution of salt (NaCl) and water.

In an embodiment, crushing the lignocellulose material can comprise crushing the waste date seeds, the date seeds, or the combination thereof. In another embodiment, the lignocellulose material can be crushed to a size of about 170 μm to about 190 μm, about 170 μm, about 175 μm, about 180 μm, about 185 μm, or about 190 μm. In one specific embodiment in this regard, the lignocellulose material can be crushed to a size of about 180 μm. The crushing can be conducted using any equipment known to one of ordinary skill in the art including, by way of non-limiting example, a laboratory crusher.

In an embodiment, the mixing comprises mixing the crushed lignocellulose material with the rejected brine solution by mechanical stirring. In another embodiment, the lignocellulose material and the rejected brine solution (RBS) waste can be mixed at a ratio of about 1:90-110, w/v, about 1:95-105, w/v, or about 1:100, w/v. By way of non-limiting example in this regard, the lignocellulose material can be mixed with the rejected brine solution waste in an amount of 1 g of lignocellulose material in 100 mL of RBS).

In a further embodiment, the heating comprises heating at about 80° C. to about 99° C., about 85° C. to about 95° C., or about 90° C., and the mechanical stirring can be conducted for about 4 hours of stirring to produce a mixture comprising a dark brown slurry.

In another embodiment, filtering the mixture can produce a lignin-rich filtrate solution and a cellulose filter cake. In an embodiment, the filtering can comprise vacuum filtering, and the cellulose filter cake can be oven dried at about 105° C. for about 24 hours to produce the isolated and recovered cellulose from the lignocellulose materials.

In another embodiment, the present subject matter relates to cellulose isolated and extracted by the methods described herein. The extracted cellulose can possess advantageous properties such as strong mechanical properties, renewability, biocompatibility, biodegradability, and chemical stability, and can be used as a reinforcement in polymer composites to produce environmentally friendly products, as well as used in the production of filaments, hydrogels, aerogels, 3-D printing materials, wastewater adsorbents, and pharmaceutical drug delivery applications.

In an embodiment, the rejected brine solution used is rejected brine solution obtained from a desalination process. Accordingly, the rejected brine solution has a particularly high concentration of both sodium chloride, free chlorine, and other multivalent ions (such as magnesium and calcium). The free chlorine may provide a strong oxidizing effect, and the multivalent ions have a high charge density, and thus interact with the negatively charged carboxyl groups present in the lignocellulosic biomass, especially the hemicellulose and lignin, further disrupting the lignin matrix by breaking down bonds within the lignocellulosic network. This in turn allows oxidizing agents (such as the free chlorine) easier access to the lignin polymer. The "ionic bridging" between the biomass and multivalent ions thus weakens the lignin structure, facilitating more effective oxidation and removal.

The presence of scaling ions like calcium and magnesium (which often cause fouling in desalination systems) can be exploited to remove solid lignin residues from the processing system. Scaling ions tend to precipitate and form deposits in high salinity environments, and these deposits can trap lignin fragments, facilitating the physical removal of lignin through co-precipitation. This dual removal mechanism—chemical oxidation and physical precipitation—provides a robust approach to lignin removal.

In addition, in highly saline environments, the presence of $Ca^{2+}$ and $Mg^{2+}$ ions are known to lead to precipitation reactions, where lignin can coagulate and separate from the biomass-water mixture. This separation could enhance the efficiency of lignin recovery, allowing for easier downstream processing and recycling of biomass fractions.

This integrated approach, utilizing both the oxidative power of free chlorine and the synergistic action of multivalent ions, offers a more sustainable, efficient, and environmentally friendly solution for lignin removal from lignocellulosic waste.

In an embodiment, the rejected brine solution has a sodium ion concentration greater than 20,000 ppm, a chlorine concentration greater than 45,000 ppm, a magnesium ion concentration greater than 2,500 ppm, and a calcium ion concentration greater than 1,000 ppm. In a further embodiment, the rejected brine solution comprises a sodium ion concentration of about 23,836 ppm, a magnesium ion concentration of about 2,802 ppm, and a calcium ion concentration of about 1,342 ppm. In a further embodiment, the rejected brine solution comprises about 23,836 parts per million (ppm) sodium ions ($Na^+$), about 2,802 ppm magnesium ions ($Mg^{2+}$), about 782 ppm potassium ions ($K^+$), about 1,342 ppm calcium ions ($Ca^{2+}$), about 6,062 ppm sulfate ions ($SO_4^{2-}$), and about 48,072 ppm chlorine ions ($Cl^-$).

The present subject matter may be better understood in view of the following examples.

EXAMPLES

Example 1

Experimental Results show Lignin Removal from the Lignocellulose material by using the rejected brine waste solution.

Lignin removal from date seeds was performed according to the general methods disclosed herein. An analysis of the rejected brine solution used in this example found that the rejected brine solution comprised 23,836 parts per million (ppm) sodium ions ($Na^+$), 2,802 ppm magnesium ions ($Mg^{2+}$), 782 ppm potassium ions ($K^+$), 1,342 ppm calcium ions ($Ca^{2+}$), 6,062 ppm sulfate ions ($SO_4^{2-}$), and 48,072 ppm chlorine ions ($Cl^-$).

FIG. 1 shows the FTIR spectra of date seeds. Date seeds are a lignocellulosic waste material and therefore mainly contain alkanes, esters, ketones, aromatics and alcohols with several oxygenated functional groups. Raw date seeds showed a broad peak at 3348 $cm^{-1}$ due to the stretching vibration of the O—H bond. These peaks correspond to adsorbed moisture in the material, indicating a hydrophilic nature of date seeds. Date seeds also exhibit a peak at 2920 $cm^{-1}$ corresponding to the C—H stretching vibrations of the methoxyl groups associated with lignin. The peak at 1740 $cm^{-1}$ is due to the strong C=O stretching caused by aldehyde or α,β-unsaturated ester groups of hemicellulose. The peaks at 1620-1635 $cm^{-1}$ are the result of stretched hydrogen bonds and the bending vibrations of the hydroxyl groups bound (OH) to the cellulose structure. Peaks at 1445 $cm^{-1}$ are due to C—$H_2$ deformation vibration, where these peaks refer to the cellulose form of the carbohydrates. A sharp peak at 1025 $cm^{-1}$ represents C—O stretching and is a characteristic peak representing the cellulosic structure.

However, it is found that for treated seeds the intensity of the peak at 2920 $cm^{-1}$ corresponding to the C—H stretching vibrations of the methoxyl groups associated with lignin lowers to a very minimum level. Also, the intensity of the peak at 1025 $cm^{-1}$ representing C—O stretching and is a characteristic peak representing how the cellulosic structure broadens. All other characteristics peaks for cellulose remains present in the treated samples FTIR spectra. These changes confirm the removal of lignin from the lignocellulosic structure and an increase in the cellulose weight percentage.

Example 2

Thermogravimetric analysis (TGA) is another useful technique that can be used to predict the removal of lignin from a lignocellulosic material. TGA works on a principal of mass-loss with respect to a temperature. Under inert conditions, it works on the principal of pyrolysis. For lignocellulosic materials, TGA mass-loss curves consists of three regions: dehydration, active pyrolysis, and passive pyrolysis regions. It is known that the mass-loss in the active pyrolysis region corresponds to the decomposition of mainly cellulose and hemicellulose. However, the mass-loss in the passive pyrolysis region is due to the decomposition of lignin.

Figure 2:
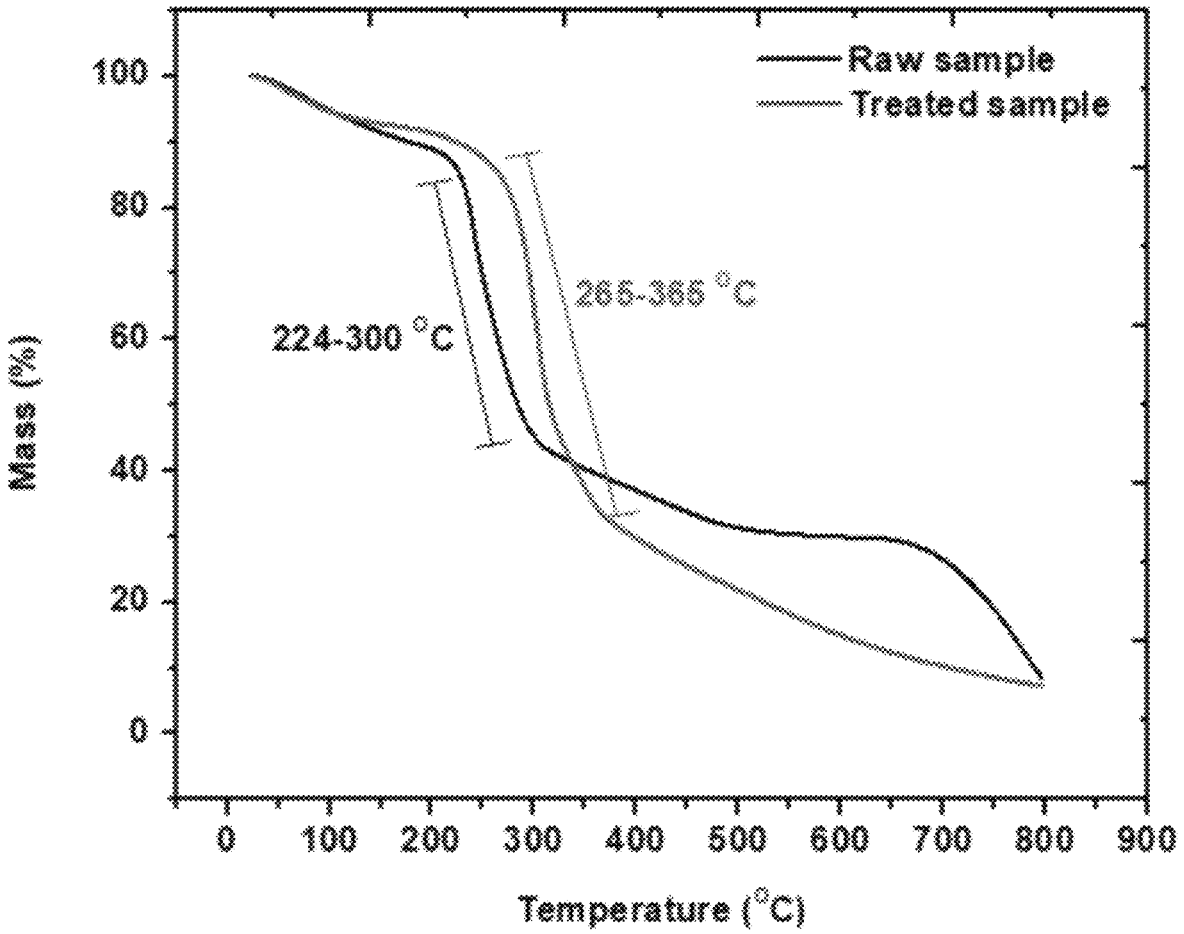
FIG. 2 shows TGA curves for raw and treated date seeds.

FIG. 2 shows the TGA mass-loss curves for the raw and treated seeds. The initial decomposition temperature of the raw seeds started at 224° C. The main decomposition range was 224-300° C. with a total mass loss of 42%. Due to the removal of lignin, an amorphous biopolymer, the initial degradation temperature for the treated sample, which is rich in cellulose, shifted to a much higher temperature of 265° C. This shift to a higher temperature is because cellulose is a crystalline biopolymer and therefore has a higher resistance to a temperature rise. The main degradation range for the treated sample, which now corresponds to the decomposition of mainly cellulose, was 265-365° C. with an overall mass loss of 55%. The increase in initial degradation temperature and mass-loss confirms the removal of lignin and an increase in cellulose content.

Example 3

Date palm seeds, a lignocellulosic waste from date palms, were treated with crude, rejected brine solution from a desalination plant. The date seeds were first crushed to 180 μm (microns) using laboratory crushers. The powdered date seeds (DS) were mechanically stirred with the rejected brine solution (RBS) over a hot plate at a weight ratio of 1:100 (1 g DS in 100 mL RBS). The operating conditions were 90° C. and 4 hours of stirring. The resultant dark brown slurry was then vacuum filtered. The filtrate was a lignin-rich solution. The filter cake, which was cellulose, was then oven dried at 105° C. for 24 hours.

It is to be understood that the process for removal of lignin from lignocellulosic materials using rejected brine solution waste to isolate and recover cellulose and the cellulose isolated and recovered by such process is not limited to the specific embodiments or examples described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A method for the removal of lignin from a lignocellulose material to extract cellulose from the lignocellulose material, the method comprising:

providing a lignocellulose material;

crushing the lignocellulose material;

providing rejected brine solution waste from a water treatment desalination plant;

mixing the crushed lignocellulose material with the rejected brine solution waste while heating to obtain a mixture; and filtering the mixture to obtain the cellulose;

wherein the rejected brine solution comprises a sodium ion concentration greater than 20,000 ppm, a chlorine concentration greater than 45,000 ppm, a magnesium ion concentration greater than 2,500 ppm, and a calcium ion concentration greater than 1,000 ppm.

2. The method of claim 1, wherein the lignocellulose material comprises a waste lignocellulose material.

3. The method of claim 1, wherein the lignocellulose material comprises waste date seeds, date seeds, or a combination thereof.

4. The method of claim 3, wherein crushing the lignocellulose material comprises crushing the waste date seeds, the date seeds, or the combination thereof.

5. The method of claim 1, wherein the lignocellulose material is crushed to a size of about 180 μm.

6. The method of claim 5, wherein the mixing comprises mixing the crushed lignocellulose material with the rejected brine solution waste by mechanical stirring.

7. The method of claim 6, wherein the crushed lignocellulose material and the rejected brine solution waste are mixed at a ratio of about 1:90-110, w/v.

8. The method of claim 7, wherein the crushed lignocellulose material and the rejected brine solution waste are mixed at a ratio of about 1:100, w/v.

9. The method of claim 6, wherein the heating comprises heating at about 90° C. and the mechanical stirring is conducted for about 4 hours to produce the mixture comprising a dark brown slurry.

10. The method of claim 1, wherein filtering the mixture produces a lignin-rich filtrate solution and a cellulose filter cake.

11. The method of claim 10, wherein the filtering comprises vacuum filtering.

12. The method of claim 10, wherein the cellulose filter cake is oven dried at about 105° C. for about 24 hours to obtain the cellulose.

13. Cellulose produced by the method of claim 1.

14. The method of claim 1, wherein the rejected brine solution comprises a sodium ion concentration of about 23,836 ppm, a chlorine ion concentration of about 48,072 ppm, a magnesium ion concentration of about 2,802 ppm, and a calcium ion concentration of about 1,342 ppm.

15. The method of claim 1, wherein the rejected brine solution comprises a sodium ion concentration of about 23,836 ppm, a chlorine ion concentration of about 48,072 ppm, a magnesium ion concentration of about 2,802 ppm, a potassium ion concentration of about 782 ppm, a calcium ion concentration of about 1,342 ppm, and a sulfate ion concentration of about 6,062 ppm.

* * * * *